United States Patent [19]

Buchtel et al.

[11] Patent Number: 4,993,105

[45] Date of Patent: Feb. 19, 1991

[54] FURNITURE GUARD WITH EXHAUST SLOTS

[75] Inventors: Dean H. Buchtel, Canton; Nick M. Bosyj, North Canton, both of Ohio

[73] Assignee: The Hoover Company, North Canton, Ohio

[21] Appl. No.: 426,851

[22] Filed: Oct. 26, 1989

[51] Int. Cl.[5] ..... A47L 5/00

[52] U.S. Cl. ..... 15/325; 15/412; 15/327.2

[58] Field of Search ..... 15/325, 327 F, 327 R, 15/412, 413, 45

[56] References Cited

U.S. PATENT DOCUMENTS

| | | | |
|---|---|---|---|
| 1,695,246 | 12/1928 | Gammeter | 15/325 |
| 1,748,853 | 2/1930 | Squires | 15/327 R |
| 1,996,934 | 4/1935 | Siedle | 15/325 |
| 2,128,525 | 8/1938 | Dyer | 15/375 |
| 2,155,669 | 4/1939 | Lofgren | 55/373 |
| 2,241,862 | 5/1941 | Langille | 15/325 |
| 2,740,981 | 4/1956 | Famolare et al. | 15/327 F |
| 2,884,185 | 4/1959 | Dolan | 15/413 X |
| 3,040,364 | 6/1962 | Carlberg | 15/325 |
| 3,270,365 | 9/1966 | Waters et al. | 15/325 |
| 3,334,371 | 8/1967 | Seeley et al. | 15/327 R |
| 3,375,541 | 4/1968 | Fromknecht | 15/327 R |
| 3,381,329 | 5/1968 | Wied | 15/327 F |
| 3,516,110 | 6/1970 | Nilsson | 15/325 |
| 3,869,265 | 3/1975 | Wolter et al. | 55/274 |
| 4,369,539 | 1/1983 | Nordeen | 15/412 |

FOREIGN PATENT DOCUMENTS

| | | | |
|---|---|---|---|
| 0521216 | 1/1956 | Canada | 15/325 |
| 2341233 | 8/1972 | Fed. Rep. of Germany . | |
| 3042894 | 5/1982 | Fed. Rep. of Germany | 15/325 |
| 3330201 | 2/1985 | Fed. Rep. of Germany | 15/325 |
| 0767647 | 3/1955 | United Kingdom . | |
| 0816416 | 12/1957 | United Kingdom . | |

*Primary Examiner*—Henry J. Recla
*Assistant Examiner*—Casey Jacyna

[57] ABSTRACT

A vacuum cleaner is provided with a furniture guard that extends around at least a portion of the cleaner. The furniture guard is slotted so as to provide for outward ventilation of cleaner air.

5 Claims, 5 Drawing Sheets

FURNITURE GUARD WITH EXHAUST SLOTS

BACKGROUND OF THE INVENTION

1. Field of the Invention

This invention relates to vacuum cleaners and, more specifically, relates to a furniture guard for use with such a vacuum cleaner.

2. Summary of the Prior Art

The use of furniture guards with vacuum cleaners to protect adjacent furniture, room walls and room woodwork when the cleaners are in use is old and well known. These furniture guards generally extend around the periphery of their cleaners and, in canister cleaners, for example, quite often extend around these cleaners intermediate relative to their height. Even with this disposition of the furniture guard which is removed from the operator and the floor and its dust and debris, no one has advantageously utilized the furniture guard as an exhaust means for cleaner air. Nor have they taken advantage of the improved appearance of the cleaner afforded with the adoption of this structure.

Accordingly, it is an object of this invention to provide a slotted furniture guard.

It is a further object of this invention to provide a vented furniture guard so as to afford a means for cleaner air discharge to atmosphere.

It is a still futher object of the invention to provide a new and improved furniture guard for a vacuum cleaner.

SUMMARY OF THE INVENTION

A canister cleaner is provided that includes a furniture guard extending around the cleaner intermediately of its height. The guard may include horizontal and vertical flanges, with the horizontal flange disposed between upper and lower shells of the canister cleaner to serve as a sealing means between them. The vertical flange of the furniture guard is slotted and the cleaner shell behind the slotted portion of the furniture guard is also slotted so that cleaner discharge air may exit to atmosphere through the furniture guard.

BRIEF DESCRIPTION OF THE DRAWINGS

Reference may now be had to the accompanying Drawings for a better understanding of the invention, both as to its organization and function, with the illustration being of a preferred embodiment, but being only exemplary, and in which.

DETAILED DESCRIPTION OF THE INVENTION

Figure 1:
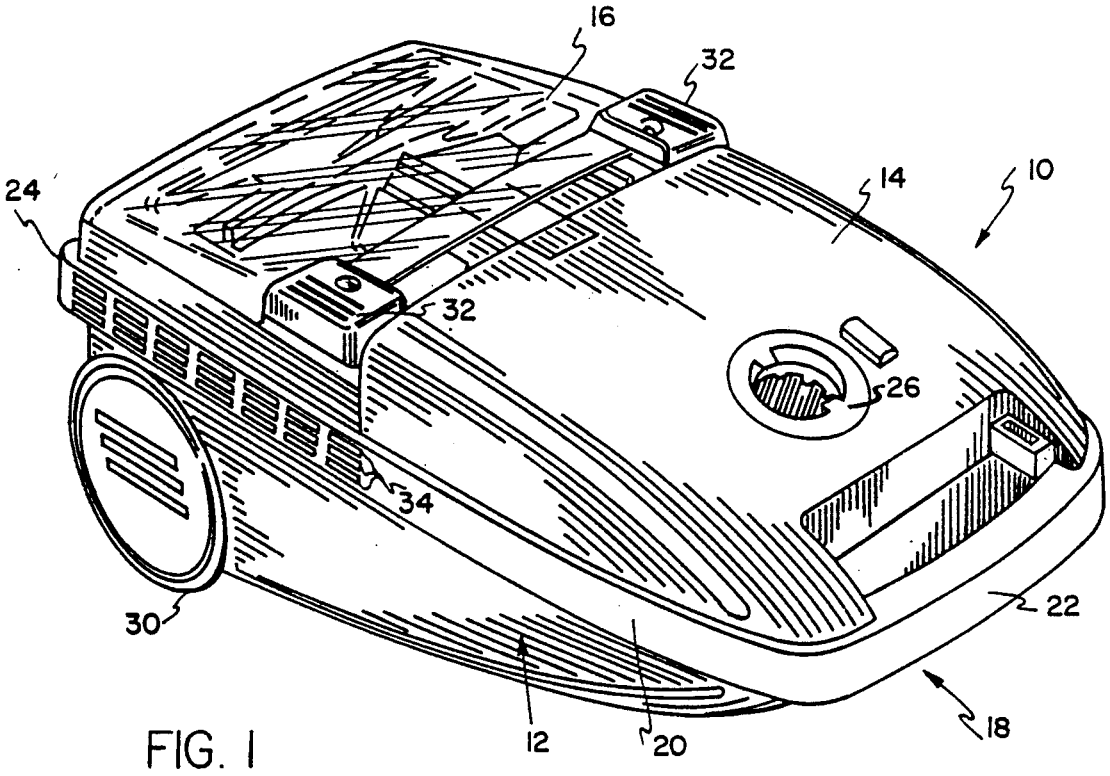
FIG. 1 is a left front perspective view of a vacuum cleaner incorporating the invention.
Figure 2:
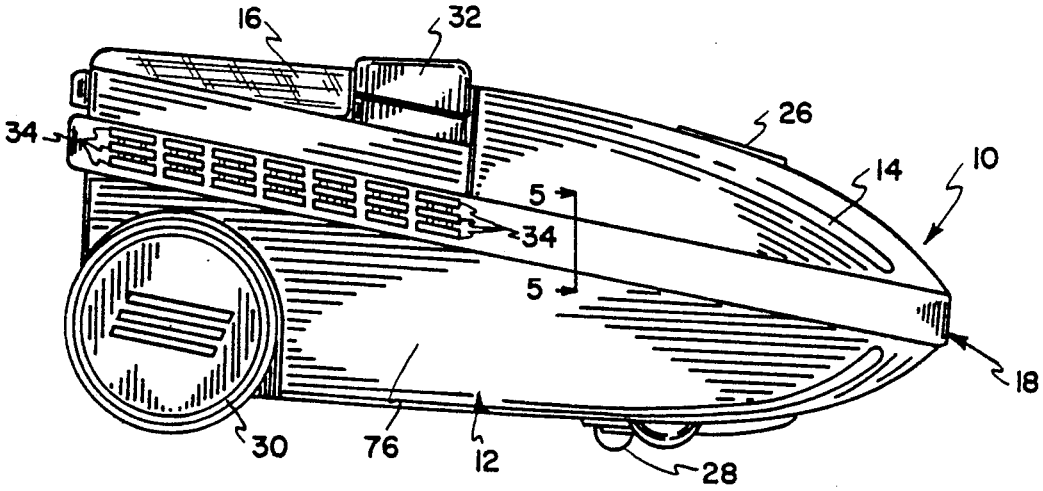
FIG. 2 is a left side elevational view thereof.
Figure 3:
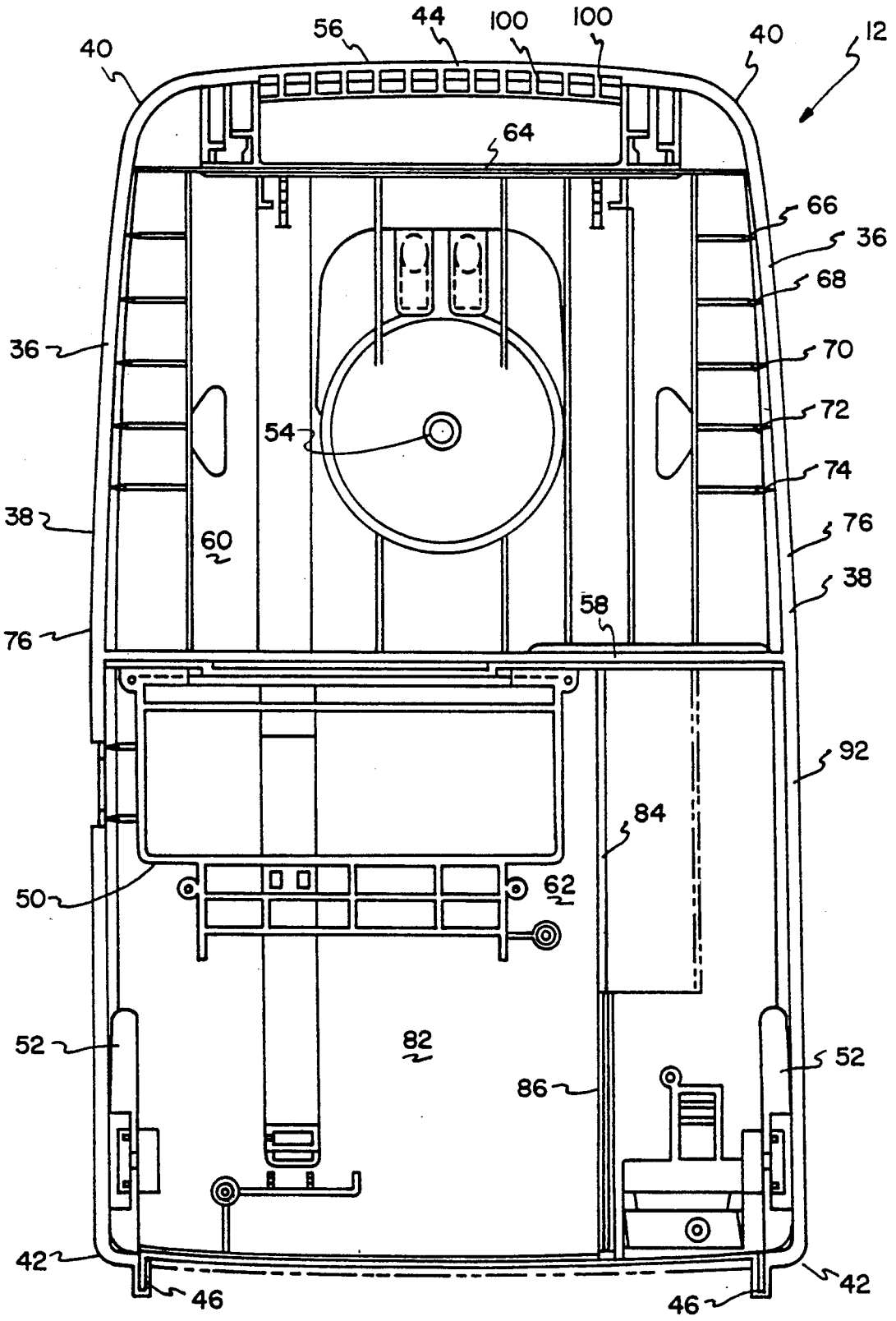
FIG. 3 is a plan view of the lower shell of the vacuum cleaner with the furniture guard removed.
Figure 4:
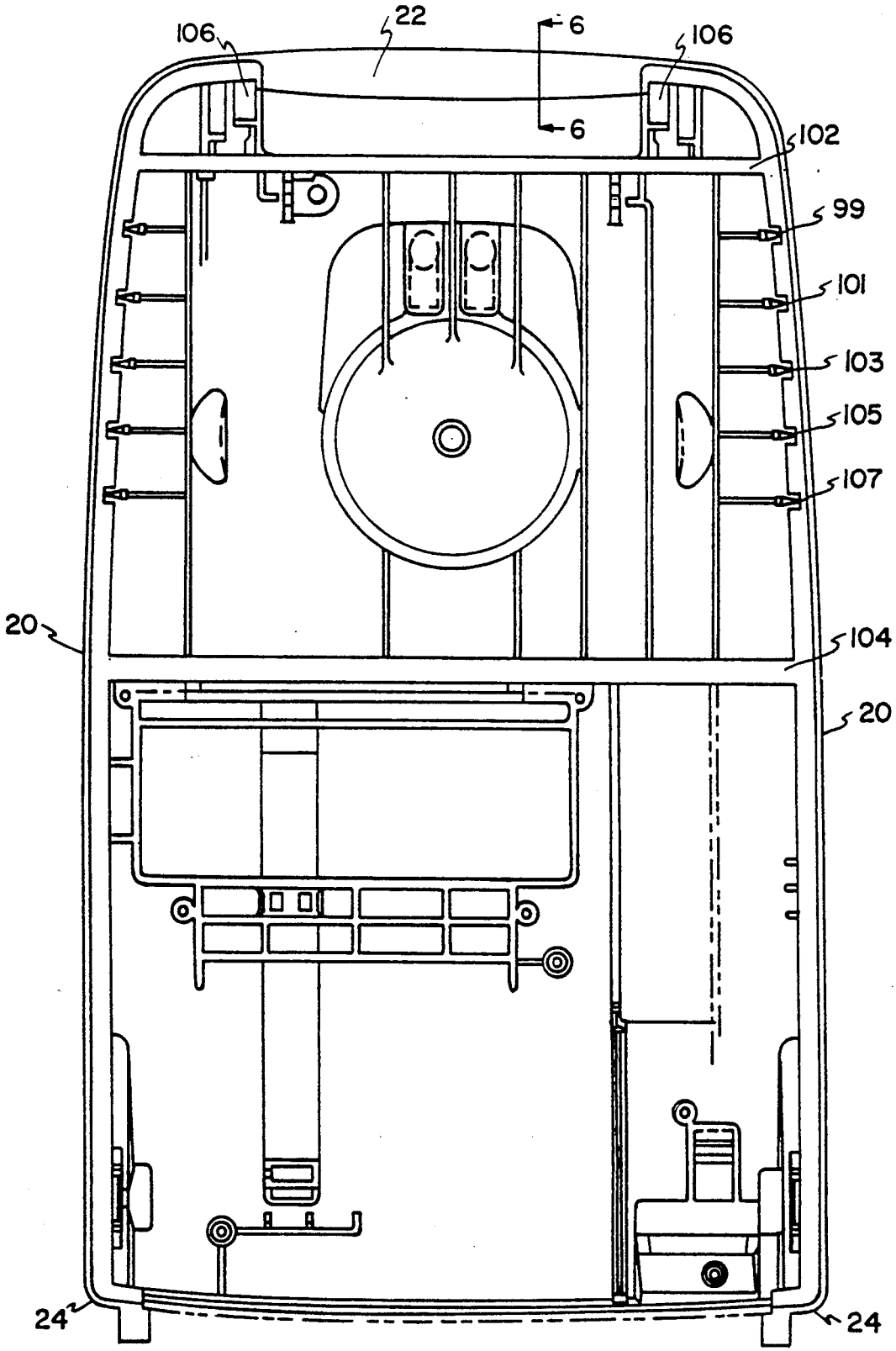
FIG. 4 is a plan view of the lower shell with the furniture guard mounted and in place.

There is shown in FIGS. 1 and 2, a vacuum cleaner 10 having a housing 11 comprised of a bottom shell 12 and a pair of top shells 14 and 16. A furniture guard 18 extends around the vacuum cleaner approximately intermediate of the upper and lower shells and includes integral side pieces 20, 20, handle piece 22 and end pieces 24, 24. Vacuum cleaner 10 also includes a suction port 26, front caster 28 and rear wheels 30, 30 (only one shown). Operating pedals 32, 32 may be included on the top of the cleaner 10 which may initiate, for example, on-off switch or cord reel operation of the cleaner 10.

Furniture guard 18 may include, in side pieces 20, 20, a series of generally axially extending through slots 34, 34, 34 that are arranged, in this instance, in seven vertical rows of threes. These slots, as it will appear, provide for the passage of cleaner exhaust discharge air from the cleaner 10, conveniently maintaining this discharge removed and directed away from possible dirt and debris on the floor and the operator of the unit and accentuating the styling of the vents by placing them in the very discernible furniture guard.

Turning to the remaining Figures of the Drawing, the bottom shell 12 is seen as including, for mounting the furniture guard 18, a peripheral lip 36 that extends around each side 38 of the bottom shell 12 and includes inturned forward end 40 and intured rearward end 42, integrally flowing from the area of each of the lips 36, 36 at each side 38, 38. Between the forward ends, 40, 40 of peripheral lip 36 is disposed an attached handle lip portion 44 which joins to each of them to continue forming a ledge for mounting the furniture guard 18. The rearward ends 42, 42 of peripheral lip 36 each terminate at a transversely extending vertically oriented short double wall 46 that mounts an end tip 92 (to be described) of end 24 of furniture guard 18.

The bottom shell 12 also includes, e.g., a cradle 50 for mounting the motor fan system (not shown) of vacuum cleaner 10, wells 52, 52 for rear wheels 30, 30, a well 54 for front caster 28, a handle 56, an intermediate partition wall 58 that separates a bag cavity 60 from a motor fan compartment 62, this wall extending upwardly from the bottom surface of bottom shell 12 to terminate upwardly on the same level as peripheral lip 36. The bottom shell also includes a front wall 64 that has an upper flat, level with the peripheral lip 36. A series of strengthening ribs 66, 68, 70, 72 and 74 also extend up a side wall 76 on each side of bottom shell 12 within the bag cavity 60 to strengthen the bottom shell 12 and prevent a dirt bag (not shown) disposed in bag cavity 60 from sealing to the walls of this cavity. These ribs extend slightly above the level of the peripheral lip 36 but are inset sufficiently so as to not interfere with the mounting of top shell 14.

The side walls 76, 76 have, adjacent their upper edges and in their rearward halves, a series of equal, vertically extending slots 78, 78, 78 spaced along the side walls 76, 76. Vertical slots in side wall 76 strengthen it relative to the use of horizontal slots in this side wall. These slots extend downwardly along the shell from just below the lip 36 along the two sides 76, 76 of bottom shell 12, near their rears, and terminate at a depth that places them safely under the furniture guard 18. A series of 28 slots is shown. Exhaust air from the motor fan system (not shown) exhausts conventionally into a rearward end 82 of the bottom shell 12 and then through an opening 84 in an interior side wall 86 of bottom shell 12 to exhaust through the vertical slots 78, 78, 78 in side wall 76 of bottom shell 12. Exhaust air moving outwardly through slots 78, 78, 78 exits the cleaner 10 through furniture guard slots 34, 34, 34 to atmosphere.

The furniture guard 18 includes, in cross section, along the side wall 76, a vertical flange 88 through which the slots 34, 34, 34 are formed. Near the top of the flange 88 is a horizontally extending, integral flange 90 that rests on a horizontal face 92 of lip 36, the flange 88 extending above the flange 90 to cover the joint between the bottom shell 12 and the top shells 14, 16 while the horizontal flange 90 extends between and seals the joint between the bottom shell 12 and the top shells 14, 16. A second short, vertical flange 95 helps maintain furniture guard 18 in position. This flange may be made discontinuous (not shown) so as to aid in assembly.

The furniture guard 18 is mounted at the rear of the cleaner 10 by an integral three sided, end tip of downwardly opening cap 92. It extends downwardly over the double wall 46 with a cover 94 of the cap limiting downward telescoping of it. A series of strengthening ribs 91, 91 and 93 extend along the sides and ends of the furniture guard 18.

Figure 5:
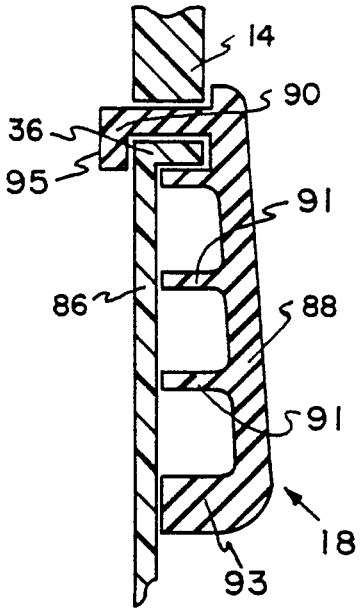
FIG. 5 is a fragmentary cross sectional view of the cleaner and furniture guard taken on line 5—5 of FIG. 2.
Figure 6:
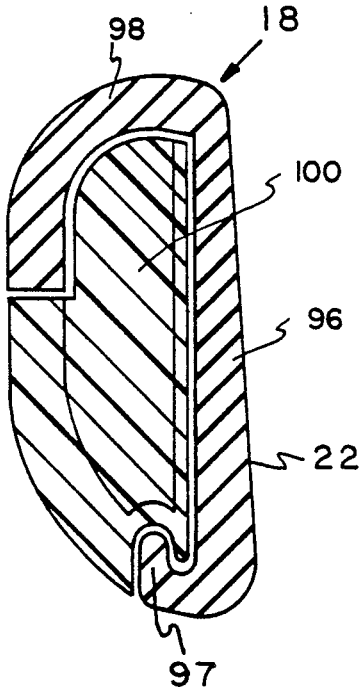
FIG. 6 is a cross sectional view of the vacuum cleaner handle with the furniture guard mounted and taken on line 6—6 of FIG. 4.
Figure 7:
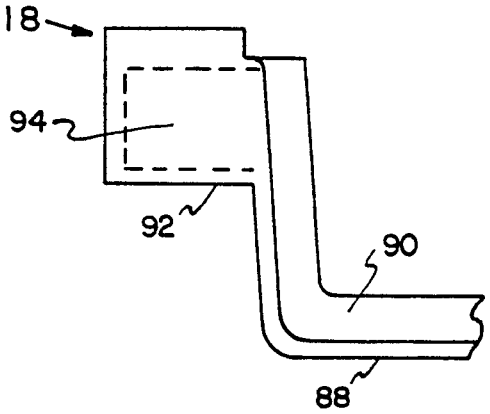
FIG. 7 is an enlarged view of the rear corner of the vacuum cleaner.
Figure 8:
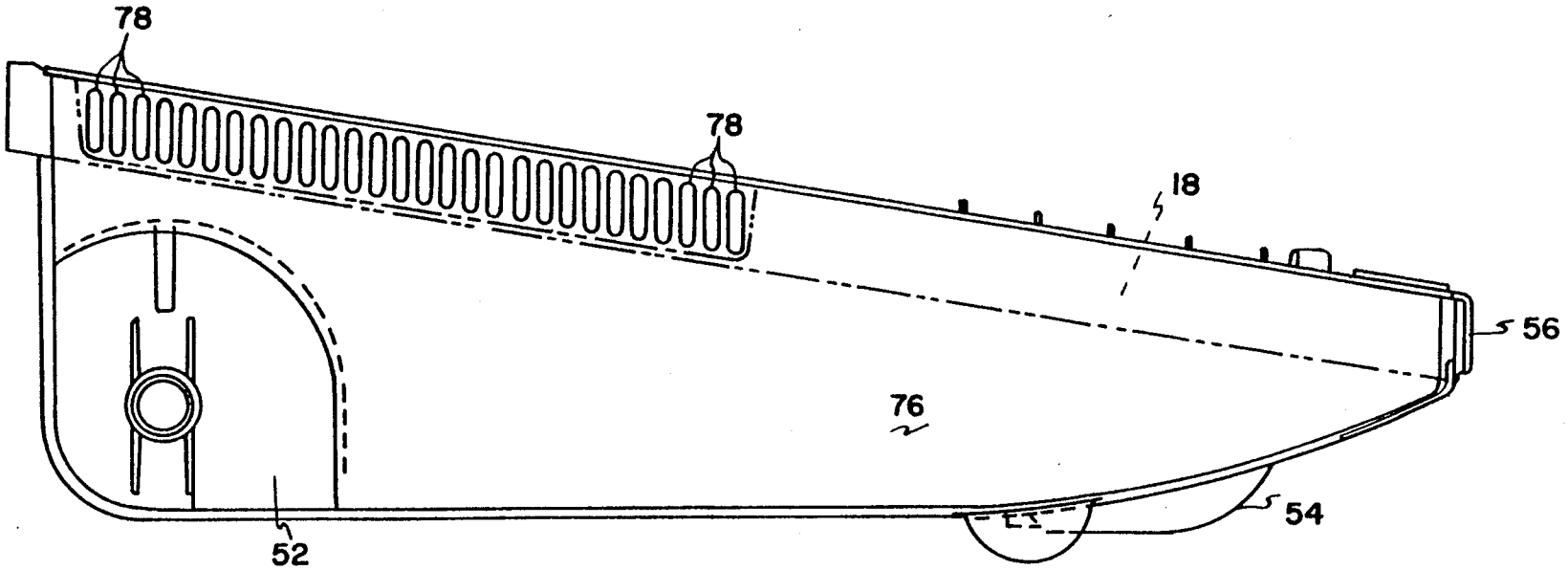
FIG. 8 is an elevational view of the bottom shell of the vacuum cleaner incorporating the invention.

At the front of the cleaner 10, the furniture guard 18 shows the same cross section as illustrated in FIG. 5 until it merges with integral furniture guard handle piece 22. The handle piece 22, in cross section, includes a vertical flange 96 to which is integrally attached a curved piece 98 in the form of a bisected "U", the curved piece 98 fitting around and down behind a series of stepped ribs 100, 100 of handle 56 to mount the furniture guard 18 to the handle 56 of the bottom shell 12. The handle piece 22 also includes at its bottom a hook portion 97 that engages with the handle 56. A lip 97 is also integral with the furniture guard 18 at the handle piece 22.

A series of short slots 99, 101, 103, 105 and 107 in furniture guard 18 nest around ribs 66, 68, 70, 72 and 74. The outline of the furniture guard 18 is completed by a pair of intgral cross pieces 102, 104 that extend across the top of front wall 64 and the top of intermediate wall 58, respectively, of bottom shell 12. These cross pieces may each have a pair of vertical spaced legs (not shown) so as to nest over front wall 64 and intermediate wall 58.

The furniture guard 18, as set out previously serves as a seal between the top and lower shells by fittingly lying on the lower shell 12 and by having the top shells 14 and 16 abuttingly lying on it. More specifically, top shell 14 is hinged (not shown) through hinge wells 106, 106 to bottom shell 12 so as to be openable to afford access to the bag cavity 60 or closed as FIGS. 1 and 2 at which time the top shell 14 is disposed in this overlying relationship. Top shell 16 also lies in abutting relationship over furniture guard 18 and is maintained in this relationship by screw or the like attachment means (not shown) between it and the bottom shell 12.

It should be obvious that many modifications can be made to the invention which would still fall within the spirit and purview of the description offered. It should also be obvious that the objects of the invention have been fully met by the structure described.

What is claimed is:

1. A vacuum cleaner having a furniture. guard attached thereto including;

(a) a series of ventilating slots in said furniture guard, (b) said series of ventilating slots having each ventilating slot extending horizontally and vertically, and (c) said ventilating slots being elongated horizontally relative to their vertical extents (d) a housing for said vacuum cleaner including a series of ventilating slots, (e) each of said housing ventilating slots extending generally horizontally and vertically, (f) said housing ventilating slots being elongated vertically relative to their horizontal extents and being disposed directly behind said furniture guard ventilating slots in overlapping relation to form a crossed pattern to provide a direct yet somewhat baffled air flow outwardly from said cleaner.

2. A vacuum cleaner having a furniture guard attached thereto including;

(a) a series of ventilating slots in said furniture guard, (b) said series of ventilating slots having each ventilating slot extending horizontally and vertically, and (c) said ventilating slots being elongated horizontally relative to their vertical extents.

(d) a housing for said vacuum cleaner includes a series of ventilating slots with each of said slots elongated vertically, (e) each of said housing ventilating slots being disposed behind one of said rows of horizontally extending furniture guard ventilating slots in overlapping relation to thereby provide a crossed pattern of said slots and a partially baffled flow to ventilating air flow through said crossed slots.

3. A vacuum cleaner having a furniture guard attached thereto according to either of claims 1 or 2 wherein;

(a) said series of furniture guard ventilating slots are disposed in vertically extending rows, in each of which are disposed several of said horizontally elongated ventilating slots.

4. A furniture guard for use with a canister cleaner including;

(a) said canister cleaner having longitudinally extending sides, a rear portion and a handle, (b) said furniture guard extending around said longitudinally extending sides and said handle and rear corners formed by said longitudinally extending sides and said rear portion, (c) said furniture guard attached to said canister cleaner adjacent said corners by a downwardly opening cap forming a well, (d) said canister cleaner having at least one projecting wall transverse to said rear portion engaged in said well, (e) said canister cleaner including vertically extending ventilating slots, (f) said furniture guard including horizontally extending ventilating slots, (g) said furniture guard mounted over said canister cleaner vertically extending ventilating slots whereby, (h) said vertically and horizontally extending ventilating slots overlap each other to form a crossed pattern.

5. A vacuum cleaner having a housing and a furniture guard mounted on said housing including;

(a) said housing provided with vertically elongated ventilating slots, (b) said furniture guard provided with horizontally elongated ventilating slots, (c) said vertically and horizonally elongated ventilating slots being disposed overlapping each other in a crossing pattern.

* * * * *